US008529210B2

(12) United States Patent
Merritt et al.

(10) Patent No.: US 8,529,210 B2
(45) Date of Patent: Sep. 10, 2013

(54) AIR CYCLE MACHINE COMPRESSOR ROTOR

(75) Inventors: Brent J. Merritt, Southwick, MA (US); Harold W. Hipsky, Willington, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 472 days.

(21) Appl. No.: 12/974,357

(22) Filed: Dec. 21, 2010

(65) Prior Publication Data

US 2012/0156026 A1 Jun. 21, 2012

(51) Int. Cl.
*F01D 5/14* (2006.01)
*F01D 5/04* (2006.01)

(52) U.S. Cl.
USPC ..... 416/223 B; 416/243; 416/DIG. 2

(58) Field of Classification Search
None
See application file for complete search history.

(56) References Cited

U.S. PATENT DOCUMENTS

| | | | | |
|---|---|---|---|---|
| 4,967,565 | A | 11/1990 | Thomson et al. | |
| 5,014,518 | A | 5/1991 | Thomson et al. | |
| 5,133,194 | A | 7/1992 | Army, Jr. et al. | |
| 5,142,762 | A | 9/1992 | Dziorny et al. | |
| 5,213,473 | A * | 5/1993 | Fiala | 416/183 |
| 5,249,934 | A | 10/1993 | Merritt et al. | |
| 5,309,735 | A | 5/1994 | Maher, Jr. et al. | |
| 5,554,000 | A | 9/1996 | Katoh et al. | |
| 5,921,683 | A | 7/1999 | Merritt et al. | |
| 6,062,819 | A * | 5/2000 | Zangeneh et al. | 416/186 R |
| 6,427,471 | B1 | 8/2002 | Ando et al. | |
| 7,186,090 | B2 | 3/2007 | Tomberg et al. | |
| 7,198,470 | B2 * | 4/2007 | Enomoto et al. | 416/185 |
| 7,384,243 | B2 | 6/2008 | Noshi | |
| 7,497,663 | B2 | 3/2009 | McRae, Jr. et al. | |
| 7,572,104 | B2 | 8/2009 | Hudson et al. | |
| 7,779,644 | B2 | 8/2010 | Decrisantis et al. | |
| 8,360,730 | B2 * | 1/2013 | Chen et al. | 416/188 |
| 2009/0220346 | A1 | 9/2009 | Schluter et al. | |

* cited by examiner

*Primary Examiner* — Nathaniel Wiehe
*Assistant Examiner* — Jeffrey A Brownson
(74) *Attorney, Agent, or Firm* — Carlson, Gaskey & Olds P.C.

(57) ABSTRACT

A compressor rotor for an air cycle machine (ACM) includes a plurality of blades that each includes a root, a tip, a first surface and second surfaces. The first and second surfaces are defined as a set of X-coordinates, Y-coordinates and Z-coordinates set out in any of Table M-1 and M-2 or Table S1 and S-2 scaled by a desired factor. The X-coordinates being in the tangential direction, the Y-coordinates being in the axial direction and the Z-coordinates being in the radial direction.

22 Claims, 3 Drawing Sheets

AIR CYCLE MACHINE COMPRESSOR ROTOR

BACKGROUND

This disclosure generally relates to rotor for an air cycle machine. An air cycle machine may include a centrifugal compressor and a centrifugal turbine mounted for co-rotation on a shaft. The centrifugal compressor further compresses partially compressed air, such as bleed air received from a compressor of a gas turbine engine. The compressed air discharges to a downstream heat exchanger or other use before returning to the centrifugal turbine. The compressed air expands in the turbine to thereby drive the compressor. The air output from the turbine may be utilized as an air supply for a vehicle, such as the cabin of an aircraft.

SUMMARY

A disclosed compressor rotor for an air cycle machine (ACM) includes a plurality of blades that each includes a root, a tip, a first surface and a second surface. The first and second surfaces are defined as a set of X-coordinates, Y-coordinates and Z-coordinates set out in any of Table M-1 and M-2 or Table S1 and S-2 scaled by a desired factor. The X-coordinates being in the tangential direction, the Y-coordinates being in the axial direction and the Z-coordinates being in the radial direction.

The plurality of blades includes a plurality of main blades and a plurality of splitter blades disposed between the main blades. The main and splitter blades define a portion of a corresponding plurality of air passages through a compressor section of the disclosed ACM.

These and other features disclosed herein can be best understood from the following specification and drawings, the following of which is a brief description.

DETAILED DESCRIPTION

Figure 1:
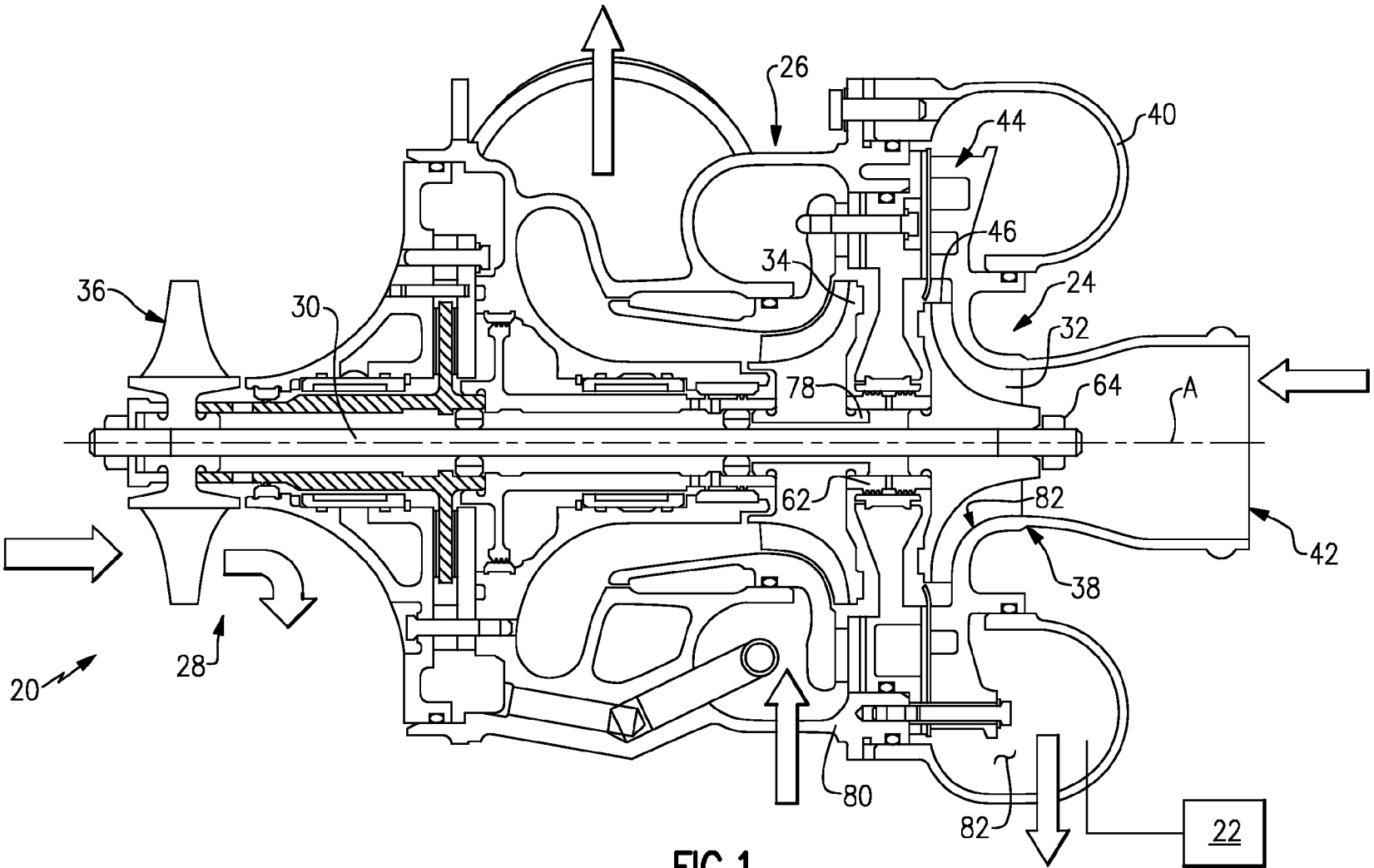
FIG. 1 is a schematic view of an example air cycle machine.

FIG. 1 shows an example air cycle machine 20 ("ACM") that is incorporated into an air supply system 22 of a vehicle, such as an aircraft, helicopter, or land-based vehicle. The ACM 20 includes a compressor section 24, a turbine section 26 and a fan section 28 that are generally disposed about a main shaft 30 that includes a tie rod. The compressor section 24 includes a compressor rotor 32, the turbine section 26 includes a turbine rotor 34, and the fan section 28 includes a fan rotor 36. The compressor rotor 32, turbine rotor 34, and fan rotor 36 are secured on the main shaft 30 for co-rotation about an axis A.

The example compressor section 24 includes the compressor rotor 32, a diffuser 38, and compressor housing 40 that define a portion of a compressor air flow path. The diffuser 38 defines an inlet 42 into the ACM 20 to the compressor rotor 32. The diffuser 38 further defines radial flow passages 44 that extend radially away from an outer periphery 46 of the compressor rotor 32.

Figure 3:
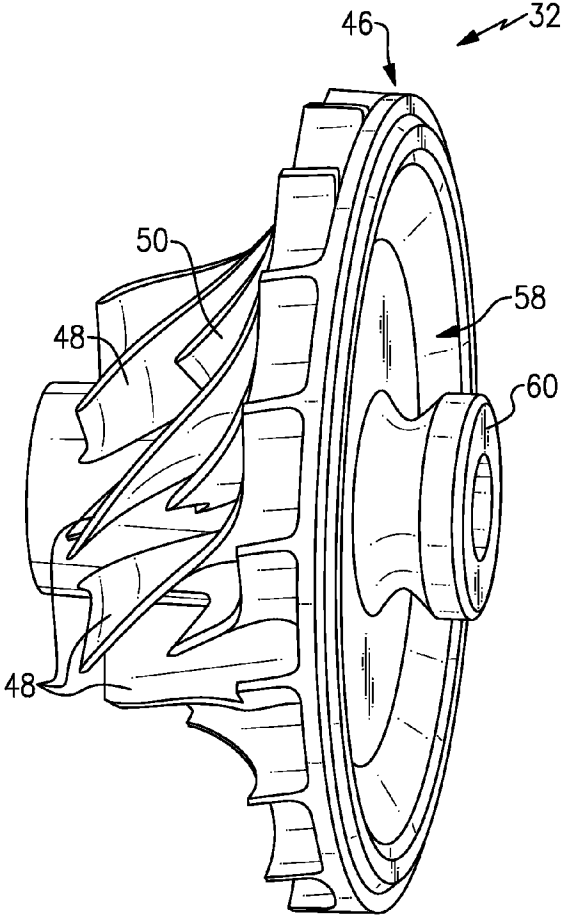
FIG. 3 is a perspective view of a back side of the example compressor rotor.
Figure 2:
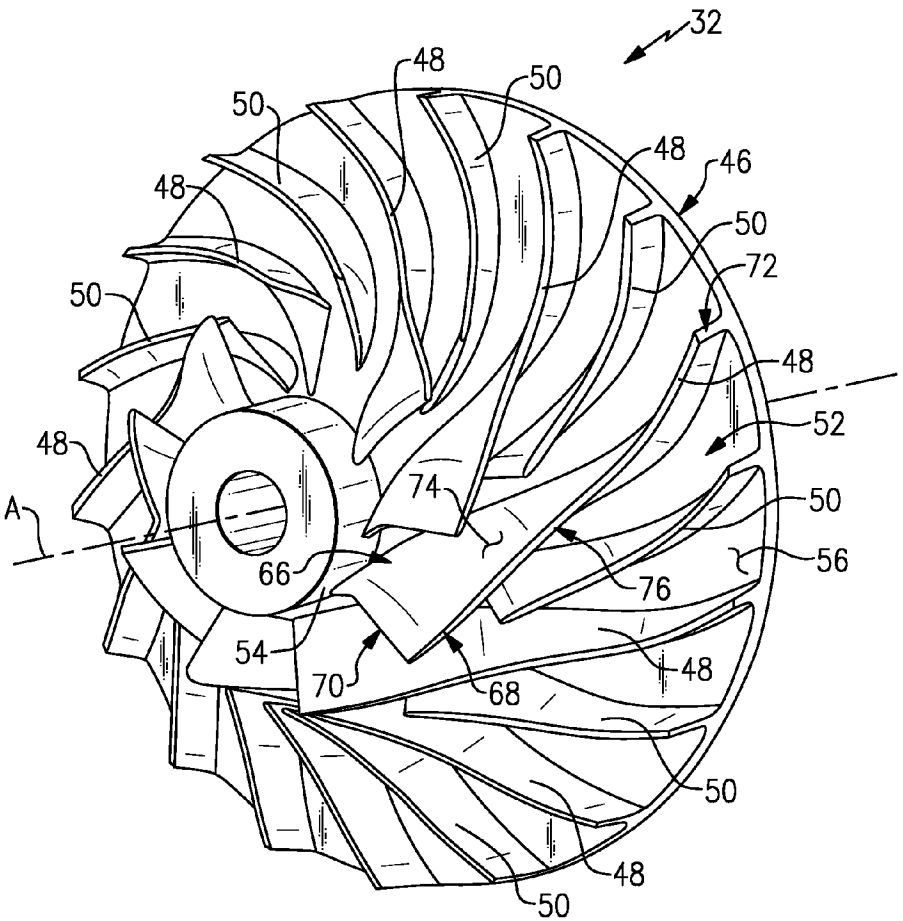
FIG. 2 is a perspective view of a front side of an example compressor rotor.

Referring to FIGS. 2 and 3, with continued reference to FIG. 1, the compressor rotor 32 includes a plurality of main blades 48 and a corresponding plurality of splitter blades 50. The splitter blades 50 are disposed between the main blades 48 and do not extend the full length of the main blades 48. The blades 48, 50 extend from a contoured surface 52 that transitions from an axially parallel portion 54 near a center of the compressor rotor 32 to a transverse surface 56 that is transverse to the axis A at the outer periphery 46 of the compressor rotor 32.

Incoming airflow initially encounters the plurality of main blades 48 near the axial portion 54 of the compressor rotor 32 and is directed through passages defined between the plurality of main blades 48 and the plurality of splitter blades 50 to the outer periphery 46. At the outer periphery 46 of the compressor rotor 32, airflow is further directed radially outward through the passages 44 defined in the diffuser 38.

The compressor rotor 32 includes a back side 58 that is not exposed to airflow and includes a surface substantially transverse to the axis of rotation A. A guide lug 60 extends axially from the back side 58 of the compressor rotor 32 and is received within a bore of a seal shaft 62 (Shown in FIG. 1). The turbine rotor 34 is also secured to the seal shaft 62 such that both the turbine rotor 34 and the compressor rotor 32 rotate as a single unit. A fastening member 64 attached to an end of the main shaft 30 secures the compressor rotor 32 in place.

The main blades 48 and splitter blades 50 include a root 66, a tip 68, a leading edge 70, a trailing edge 72, a left surface 74 and a right surface 76 that are contoured to provide a desired airflow through the compressor section 24. The main blades 48 and the splitter blades 50 extend from the contoured hub surface 52 that is defined between the main blades 48 and the splitter blades 50. The contoured hub surface 52 along with the surfaces of the main blades 48 and the splitter blades 50 are defined utilizing computational fluid dynamics (CFD) analytical software and are tailored to providing the performance requirements for the specified ACM performance parameters.

The configuration of the left and right surfaces 74,76 of each main blade 48 and each splitter blade 50 changes in view of various dimensional parameters such as for example, curvature, thickness, twist, taper from the root tip, radius from the leading edge, radius from the trailing edge, and straightness of the leading and trailing edges from root to tip. Moreover, the example compressor rotor 32 may be directly scaled up or down to meet different ACM performance requirements.

Figure 4:
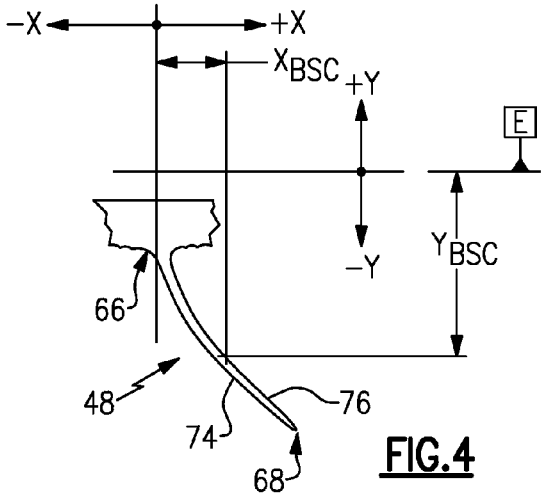
FIG. 4 is sectional view of a blade for the example compressor rotor.
Figure 5:
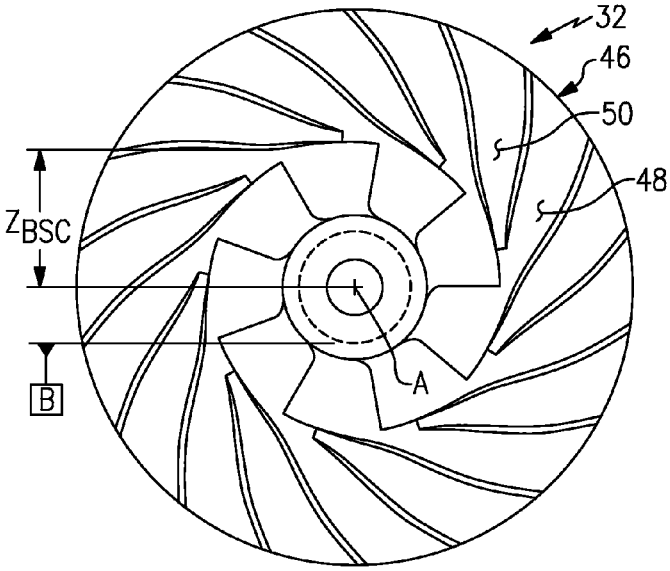
FIG. 5 is plan view of the example compressor rotor.
Figure 6:
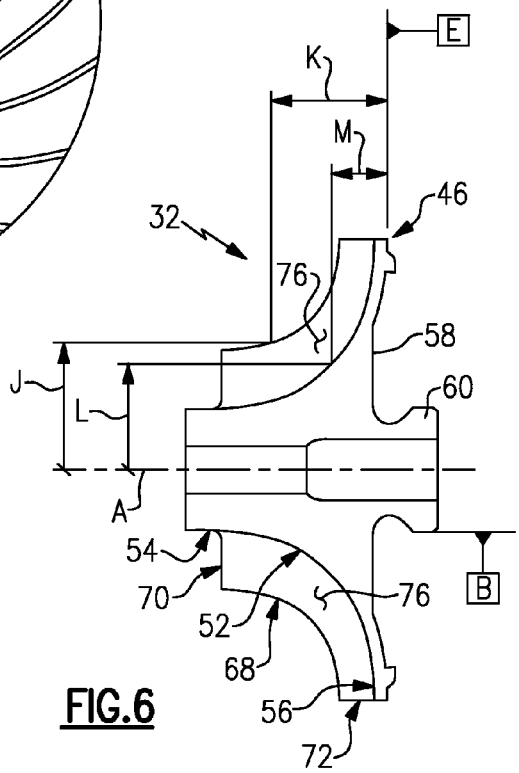
FIG. 6 is a cross sectional view of the example compressor rotor.

Referring to FIGS. 4, 5 and 6, each of the plurality of main and splitter blades 48, 50 includes the left surface 74 and the right surface 76 that are shaped to provide a continuous contour from the leading edge 70 to the trailing edge 72. In this disclosed example embodiment, Left and right is determined viewing the front (FIG. 5) of the compressor rotor 32 including the main and splitter blades 48, 50.

The shape of each of the main and splitter blades 48, 50 may be defined by a set of points such as in this example, Cartesian coordinates along a boundary of each of the surfaces.

Because a word description is difficult to construct that fully captures the three dimensional contours of each blade surface, one non-limiting dimensional embodiment is provided for the left and right blade surfaces in tables M1 and M2.

The Tables M1 and M2 are shown in a Cartesian coordinate system for X, Y and Z of each blade surface. The Cartesian coordinate system has orthogonally related X, Y and Z axes with the Z-axis extending generally in a radial direction relative to the axis of Rotation A and related with respect to Datum B. The X and Y coordinate values for determining the blade surface at each radial location are provided with respect to Z, wherein the Z coordinate values in the Tables disclosed represent a non-dimensionalized value equal to one (1) at Datum B. That is the disclosed, non-dimensionalized value Z in the Tables is provided as a ratio with respect to Datum B. It should be understood that a variety of reference Datums may alternatively or additionally be used.

By defining X and Y coordinate values at selected locations in the radial direction, i.e., in a Z direction with respect to Datum B, the left and right surfaces of the blades 48, 50 are ascertained. By connecting the X and Y values with smooth continuing arcs, each profile surface at the associated radial distance Z is defined. The surface profiles at the various radial locations between the radial distances Z are thereby ascertained by connecting adjacent surface profiles. Although the X, Y and Z axes are orientated in the disclosed fashion, it should be appreciated that the X, Y and Z axes may have any orientation provided that the axes are orthogonally oriented with respect to each other and one axis extends along a height of the blade.

The Table values are provided in inches and present actual airfoil profiles in ambient, non-operating or non-hot conditions for an uncoated airfoil, the coatings for which are described below.

TABLES M1

| Main Blade Right Surf | | |
|---|---|---|
| X BSC | Y BSC | Ratio (Z BSC/-B-) |
| 0.4281 | −0.1434 | 1.7167 |
| 0.4324 | −0.1684 | 1.7154 |
| 0.4542 | −0.2192 | 1.6719 |
| 0.4708 | −0.2452 | 1.6302 |
| 0.4931 | −0.2480 | 1.5487 |
| 0.5033 | −0.2019 | 1.4626 |
| 0.5094 | −0.1577 | 1.3675 |
| 0.5195 | −0.1667 | 1.2771 |
| 0.5383 | −0.2298 | 1.2018 |
| 0.5555 | −0.2894 | 1.1711 |
| 0.5613 | −0.3084 | 1.0882 |
| 0.5445 | −0.2783 | 0.9892 |
| 0.5336 | −0.2645 | 0.9461 |
| 0.5158 | −0.2689 | 0.8422 |
| 0.5073 | −0.3025 | 0.7637 |
| 0.5341 | −0.3727 | 0.7565 |
| 0.5690 | −0.4462 | 0.7478 |
| 0.5719 | −0.4863 | 0.6811 |
| 0.5253 | −0.4756 | 0.5863 |
| 0.4995 | −0.4731 | 0.5376 |
| 0.4691 | −0.4975 | 0.4582 |
| 0.4642 | −0.5745 | 0.3719 |
| 0.5321 | −0.6396 | 0.3736 |
| 0.6140 | −0.7178 | 0.3316 |
| 0.6269 | −0.7776 | 0.2324 |
| 0.5525 | −0.8002 | 0.1579 |
| 0.4736 | −0.8082 | 0.1175 |
| 0.4753 | −0.8575 | 0.0567 |
| 0.5162 | −0.8843 | 0.0262 |
| 0.5984 | −0.8893 | 0.0262 |

TABLE M2

| Main Blade Left Surf | | |
|---|---|---|
| X BSC | Y BSC | Ratio (Z BSC/-B-) |
| 0.3902 | −0.1185 | 1.7323 |
| 0.4004 | −0.1685 | 1.7288 |
| 0.4245 | −0.2193 | 1.6832 |
| 0.4424 | −0.2454 | 1.6394 |
| 0.4653 | −0.2486 | 1.5541 |
| 0.4739 | −0.2030 | 1.4669 |
| 0.4713 | −0.1556 | 1.4185 |
| 0.4771 | −0.1387 | 1.3220 |
| 0.4868 | −0.1697 | 1.2798 |
| 0.5038 | −0.2278 | 1.2424 |
| 0.5230 | −0.2885 | 1.2043 |
| 0.5292 | −0.3087 | 1.1181 |
| 0.5100 | −0.2789 | 1.0229 |
| 0.4870 | −0.2389 | 0.9645 |
| 0.4640 | −0.2596 | 0.8285 |
| 0.4858 | −0.3511 | 0.7736 |
| 0.5210 | −0.4282 | 0.7581 |
| 0.5445 | −0.4791 | 0.7337 |
| 0.5508 | −0.5236 | 0.6677 |
| 0.5287 | −0.5410 | 0.5924 |
| 0.4734 | −0.5613 | 0.4759 |
| 0.4093 | −0.5942 | 0.3649 |
| 0.4103 | −0.6516 | 0.3130 |
| 0.4888 | −0.7181 | 0.3032 |
| 0.5695 | −0.7522 | 0.3104 |
| 0.6220 | −0.8075 | 0.2408 |
| 0.5507 | −0.8487 | 0.1421 |
| 0.4703 | −0.8535 | 0.1149 |
| 0.4322 | −0.8928 | 0.0495 |
| 0.4736 | −0.9149 | 0.0031 |

Further, the contour of each of the first and second surfaces 48, 50 for the splitter blades is provided in tables S1 and S2 respectively.

TABLES S1

| Splitter Blade Right Surf | | |
|---|---|---|
| X BSC | Y BSC | Ratio (Z BSC/-B-) |
| 0.4279 | −0.1434 | 1.7175 |
| 0.4807 | −0.2463 | 1.5954 |
| 0.4969 | −0.2244 | 1.5140 |
| 0.5019 | −0.1540 | 1.4181 |
| 0.5142 | −0.1611 | 1.3295 |
| 0.5391 | −0.2465 | 1.2659 |
| 0.5571 | −0.2935 | 1.1515 |
| 0.5439 | −0.2517 | 1.0898 |
| 0.5272 | −0.2122 | 1.0213 |
| 0.5338 | −0.2603 | 0.9525 |
| 0.5430 | −0.2983 | 0.9279 |
| 0.5539 | −0.3377 | 0.9045 |
| 0.5677 | −0.4118 | 0.8125 |
| 0.5333 | −0.3798 | 0.7428 |
| 0.4951 | −0.3516 | 0.6676 |
| 0.4715 | −0.3492 | 0.6107 |
| 0.4655 | −0.3705 | 0.5763 |
| 0.5032 | −0.4368 | 0.5878 |
| 0.5504 | −0.5043 | 0.5989 |
| 0.5787 | −0.5486 | 0.5892 |
| 0.5499 | −0.5501 | 0.5422 |

TABLE S2

| Splitter Blade Left Surf | | |
|---|---|---|
| X BSC | Y BSC | Ratio (Z BSC/-B-) |
| 0.3904 | −0.1185 | 1.7317 |
| 0.4007 | −0.1685 | 1.7276 |

TABLE S2-continued

| Splitter Blade Left Surf | | |
|---|---|---|
| X BSC | Y BSC | Ratio (Z BSC/-B-) |
| 0.4253 | −0.2194 | 1.6805 |
| 0.4558 | −0.2470 | 1.5912 |
| 0.4649 | −0.1529 | 1.4581 |
| 0.4731 | −0.1348 | 1.3619 |
| 0.4942 | −0.1968 | 1.2721 |
| 0.5125 | −0.2567 | 1.2293 |
| 0.5246 | −0.2926 | 1.1850 |
| 0.5278 | −0.3030 | 1.1404 |
| 0.5101 | −0.2715 | 1.0473 |
| 0.4886 | −0.2300 | 0.9930 |
| 0.4715 | −0.2321 | 0.8980 |
| 0.4796 | −0.2760 | 0.8641 |
| 0.5067 | −0.3331 | 0.8781 |
| 0.5390 | −0.4120 | 0.8496 |
| 0.4784 | −0.4049 | 0.6798 |
| 0.4251 | −0.4181 | 0.5540 |
| 0.4462 | −0.4724 | 0.5341 |
| 0.5288 | −0.5372 | 0.5965 |
| 0.5597 | −0.5673 | 0.6041 |
| 0.5425 | −0.5788 | 0.5251 |

A tip contour of each of the main and splitter blades corresponds with a corresponding surface of the diffuser 38 (FIG. 1) to define a portion of the airflow passages through the compressor section 24. The contour of the tip surface 68 of both the main and splitter blades 48, 50 is defined relative to the hub contour surface 52. In one non-limiting dimensional embodiment, the tip surface contour of each of the main and splitter blades 48, 50 are defined by a paired axial dimension K and radial dimensions J.

In one non-limiting dimensional embodiment, the hub contour surface 52 is defined by a set of paired axial dimensions M and radial dimensions L. The axial dimensions K and M are defined from the back side 58 of the compressor rotor 32 as specified by the datum surface E (FIG. 6). The tip profile is disclosed in terms of the axial dimension K and the radial dimension J. The hub profile is disclosed in terms of the axial dimension M and the radial dimension L in the respective Tables. The J and L dimensions are defined in a generally radial direction relative to the axis of rotation A and as related to Datum B. The J and L coordinate values for determining the respective tip and hub profile at the associated axial coordinates K and M in the Tables are provided as a ratio with respect to Datum B. That is, the J and L coordinate values in the Tables represent a non-dimensionalized value equal to one (1) at Datum B. It should be understood that a variety of reference Datums may alternatively or additionally be used. The Table values are provided in inches, and represent actual blade profiles at ambient, non-operating or non-hot conditions for an uncoated airfoil, the coatings for which are described below. In this non-limiting dimensional embodiment, the set of paired dimensions K and J that define the tip surface 68 contour are defined in the table T-1.

TABLE T-1

| Tip | |
|---|---|
| K | Ratio (J Rad/-B-) |
| −1.0764 | 0.9537 |
| −0.9349 | 0.9537 |
| −0.9245 | 0.9537 |
| −0.9095 | 0.9539 |
| −0.8890 | 0.9550 |
| −0.7911 | 0.9648 |

TABLE T-1-continued

| Tip | |
|---|---|
| K | Ratio (J Rad/-B-) |
| −0.7332 | 0.9760 |
| −0.6945 | 0.9871 |
| −0.6366 | 1.0097 |
| −0.5795 | 1.0403 |
| −0.4868 | 1.1095 |
| −0.4359 | 1.1658 |
| −0.3375 | 1.2569 |
| −0.3532 | 1.3080 |
| −0.3189 | 1.4042 |
| −0.3008 | 1.4764 |
| −0.2876 | 1.5504 |
| −0.2772 | 1.6405 |
| −0.2730 | 1.7013 |
| −0.2702 | 1.7621 |
| −0.2688 | 1.8081 |
| −0.2681 | 1.8338 |
| −0.2679 | 1.8386 |
| −0.2671 | 1.8746 |

Moreover, in this non-limiting dimensional embodiment, the set of paired dimensions M and L that define the hub contour surface 52 are defined in table H-1.

TABLE H-1

| Hub | |
|---|---|
| M | Ratio (L Rad/-B-) |
| −1.1219 | 0.4708 |
| −1.0590 | 0.4907 |
| −0.9778 | 0.4844 |
| −0.9396 | 0.4881 |
| −0.9101 | 0.4907 |
| −0.8809 | 0.4935 |
| −0.7537 | 0.5112 |
| −0.6727 | 0.5325 |
| −0.5866 | 0.5680 |
| −0.4992 | 0.6216 |
| −0.4016 | 0.7087 |
| −0.2813 | 0.8724 |
| −0.2160 | 0.9961 |
| −0.1591 | 1.1412 |
| −0.1248 | 1.2621 |
| −0.0943 | 1.4220 |
| −0.0828 | 1.5185 |
| −0.0746 | 1.6292 |
| −0.0722 | 1.6819 |
| −0.0703 | 1.7407 |
| −0.0692 | 1.7818 |
| −0.0681 | 1.8288 |
| −0.0680 | 1.8338 |
| −0.0674 | 1.8555 |
| −0.0579 | 2.2494 |

The contoured tip surface 68 and hub surface 52 are defined from the leading edge 70 to the trailing edge 72 by the disclosed dimensional embodiments defined in tables T-1 and H-1. The defined dimension can be directly scaled up or down to tailor compressor rotor configuration to ACM 20 specific requirements while remaining within the scope and contemplation of the disclosed dimensional embodiment.

As the blades heat up during operation, applied stresses and temperatures induced to the blades may inevitably cause some deformation of the airfoil shape, and hence there is some change or displacement in the table coordinate values. While it is not possible to measure the changes in the Table coordinate values in operation, it has been determined that the Table coordinate values plus the deformation in use, enables efficient, safe and smooth operation.

It is appreciated that the Table coordinate values may be scaled up or down geometrically in order to be introduced into other similar machine designs. It is therefore contemplated that a scaled version of the Table coordinate values set fourth may be obtained by multiplying or dividing each of the Table coordinates values by a predetermined constant n. It should be appreciated that the Table coordinate values could be considered a scaled profile with n set equal to 1, and greater or lesser dimensioned components are obtained by adjusting n to values greater or lesser than 1, respectively.

The Table values are computer-generated and shown to four decimal places. However, in view of manufacturing constraints, actual values useful for manufacture of the component are considered to be the values to determine the claimed profile. There are, for example, typical manufacturing tolerances which must be accounted for in the profile. Accordingly, the Table coordinate values are for a nominal component. It will therefore be appreciated that plus or minus typical manufacturing tolerances are applicable to the Table coordinate values and that a component having a profile substantially in accordance with those values includes such tolerances. For example, a manufacturing tolerance of about +–0.030 inches (0.76 mm) should be considered within design limits for the component. Thus, the mechanical and aerodynamic function of the component is not impaired by manufacturing imperfections and tolerances, which in different embodiments may be greater or lesser than the values set forth in the disclosed Tables. As appreciated by those in the art, manufacturing tolerances may be determined to achieve a desired mean and standard deviation of manufactured components in relation to the ideal component profile points set forth in the disclosed Tables.

In addition, the component may also be coated for protection against corrosion and oxidation after the component is manufactured, according to the values of the Tables and within the tolerances explained above. Consequently, in addition to the manufacturing tolerances for the Table coordinates values, there may also be an addition to account for the coating thickness. It is contemplated that greater or lesser coating thickness values may be employed in alternative embodiments of the invention. Consequently, in addition to the manufacturing tolerances, there is also a modification to the Table coordinate values to account for potential coating thicknesses. It is contemplated that greater or lesser coating thickness values may be employed in alternative embodiments of the invention.

Referring to FIG. 1, assembly of the compressor rotor 32 within the disclosed ACM 20 includes mounting of the turbine rotor 34, fan rotor 36 to the main shaft 30. The example turbine rotor 34 includes a guide lug portion 78 that is received into one end of the seal shaft 62. The compressor rotor 32 is attached to the main shaft 30 such that the guide lug 60 is received within a second end of the seal shaft 62 opposite the side on which the turbine rotor 34 is secured. The fastener 64 is attached to the main shaft 30 and holds the compressor rotor 32 in place. The diffuser 38 is then secured to an ACM housing portion 80. A portion of the diffuser 38 includes a contoured surface 82 that follows the tip surface 68 of the compressor rotor 32 with a clearance to provide for rotation. The example diffuser 38 defines the inlet 42 to the compressor rotor 32 and the radially extending outlet passages 44 into a compressor outlet passage 82 defined by the compressor housing 40. The compressor outlet passage 82 is at least partially defined by the compressor housing 40 attached and sealed to the diffuser 38.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A compressor rotor for an air cycle machine comprising:

a hub including a plurality of blades extending therefrom, each of the plurality of blades including a root, a tip, first and second surfaces, wherein the each of the first and second surfaces are defined as a set of X-coordinates, Y-coordinates and Z-coordinates set out in any of Table M-1 and M-2 or Table S1 and S-2 scaled by a desired factor, the X-coordinates being in the tangential direction, the Y-coordinates being in the axial direction and the Z-coordinates being in the radial direction.

2. The compressor rotor as recited in claim 1, wherein the plurality of blades include a tip contour defined by a set of points as defined in Table T-1 scaled to a desired factor, the set of points including paired axial dimensions K from a reference surface and radial dimensions J from a center line of the compressor rotor.

3. The compressor rotor as recited in claim 1, wherein a surface between the plurality of blades includes a hub contour defined as a set of points defined in Table H-1 scaled to a desired factor, the set of points including paired axial dimensions M from a reference surface and a radial dimension L from a center line of the compressor rotor.

4. The compressor rotor as recited in claim 1, wherein the plurality of blades comprise a plurality of main blades defined by the X-coordinates, Y-coordinates and Z-coordinates set out in tables M1 and M2, and a corresponding plurality of splitter blades disposed between the plurality of main blades defined by the X-coordinates, Y-coordinates and Z-coordinates set out in tables S1 and S2.

5. The compressor rotor as recited in claim 1, wherein each of the plurality of blades include a substantially uniform width between the first and second surfaces.

6. The compressor rotor as recited in claim 1, wherein each of the surfaces defined by said Tables is adjusted by a manufacturing tolerance.

7. The compressor rotor as recited in claim 6, wherein said manufacturing tolerance is about +–0.030 inches (0.76 mm).

8. A compressor rotor for an air cycle machine comprising:

a hub including a plurality of blades extending therefrom, each of the plurality of blades including a root, a tip, a first surface and a second surface, wherein a tip contour is defined by a set of points as defined in Table T-1 scaled to a desired factor, the set of points including paired axial dimensions K from a reference surface and radial dimensions J from a center line of the compressor rotor.

9. The compressor rotor as recited in claim 8, wherein a hub surface disposed between the plurality of blades is defined by a set of points defined in Table H-1 scaled to a desired factor, the set of points including paired axial dimensions M from a reference surface and a radial dimension L from a center line of the compressor rotor.

10. The compressor rotor as recited in claim 8, wherein the plurality of blades comprise a plurality of main blades defined by a set of X-coordinates, Y-coordinates and Z-coordinates set out in tables M1 and M2, and a corresponding plurality of splitter blades disposed between the plurality of main blades defined by the X-coordinates, Y-coordinates and Z-coordinates set out in tables S1 and S2.

11. The compressor rotor as recited in claim 8, wherein each of the surfaces defined by the Tables is adjusted by a manufacturing tolerance.

12. An air cycle machine comprising:

a main shaft having a fan, a turbine rotor and a compressor rotor mounted for rotation about an axis;

a housing supporting rotation of the main shaft; and a compressor diffuser mounted proximate the compressor rotor for directing airflow from compressor rotor, wherein the compressor rotor includes a plurality of blades extending therefrom, each of the plurality of blades including a root, a tip, first and second surfaces, wherein the each of the first and second surfaces are defined as a set of X-coordinates, Y-coordinates and Z-coordinates set out in any of Table M-1 and M-2 or Table S1 and S-2 scaled by a desired factor, the X-coordinates being in the tangential direction, the Y-coordinates being in the axial direction and the Z-coordinates being in the radial direction.

13. The air cycle machine as recited in claim 12, wherein the plurality of blades comprise a plurality of main blades defined by a set of X-coordinates, Y-coordinates and Z-coordinates set out in tables M1 and M2, and a corresponding plurality of splitter blades disposed between the plurality of main blades defined by the X-coordinates, Y-coordinates and Z-coordinates set out in tables S1 and S2.

14. The air cycle machine as recited in claim 12, wherein a tip contour is defined by a set of points as defined in Table T-1 scaled to a desired factor, the set of points including paired axial dimensions K from a reference surface and radial dimensions J from a center line of the compressor rotor.

15. The air cycle machine as recited in claim 12, wherein the tip contour corresponds with a surface of the compressor diffuser.

16. The air cycle machine as recited in claim 12, wherein the compressor rotor includes a hub surface disposed between the plurality of blades is defined by a set of points defined in Table H-1 scaled to a desired factor, the set of points including paired axial dimensions M from a reference surface and a radial dimension L from a center line of the compressor rotor.

17. The air cycle machine as recited in claim 12, wherein each of the surfaces defined in each of the Tables is adjusted by a manufacturing tolerance.

18. The method of installing a compressor rotor into an air cycle machine, the method including:

mounting a compressor rotor for rotation about an axis proximate a diffuser to define at least a portion of a compressor airflow path where the compressor rotor comprises a plurality of blades extending therefrom, each of the plurality of blades including a root, a tip, first and second surfaces, wherein the each of the first surface and the second surface are defined as a set of X-coordinates, Y-coordinates and Z-coordinates set out in any of Table M-1 and M-2 or Table S1 and S-2 scaled by a desired factor, the X-coordinates being in the tangential direction, the Y-coordinates being in the axial direction and the Z-coordinates being in the radial direction.

19. The method of installing a compressor rotor as recited in claim 18, wherein the plurality of blades comprise a plurality of main blades defined by a set of X-coordinates, Y-coordinates and Z-coordinates set out in tables M1 and M2, and a corresponding plurality of splitter blades disposed between the plurality of main blades defined by the X-coordinates, Y-coordinates and Z-coordinates set out in tables S1 and S2.

20. The method of installing a compressor rotor as recited in claim 18, wherein a tip contour of the plurality of blades is defined by a set of points as defined in Table T-1 scaled to a desired factor, the set of points including paired axial dimensions K from a reference surface and radial dimensions J from a center line of the compressor rotor.

21. The method of installing a compressor rotor as recited in claim 18, including defining the tip contour to correspond with a contoured surface of the diffuser.

22. The compressor rotor as recited in claim 18, including adjusting each surface defined in each of the Tables by a manufacturing tolerance.

* * * * *